United States Patent [19]

Montuschi et al.

[11] Patent Number: 4,626,814

[45] Date of Patent: Dec. 2, 1986

[54] RAPID ACTING ELECTROMAGNETIC ACTUATOR

[75] Inventors: Mario Montuschi, Turin; Mario Palazzetti, Avigliana, both of Italy

[73] Assignee: Iveco Fiat, S.p.A., Turin, Italy

[21] Appl. No.: 650,198

[22] Filed: Sep. 13, 1984

[30] Foreign Application Priority Data

Sep. 19, 1983 [IT] Italy ..... 67963 A/83

[51] Int. Cl.[4] ..... H01F 7/08

[52] U.S. Cl. ..... 335/281; 335/282; 336/199

[58] Field of Search ..... 335/281, 282, 284, 296, 335/297; 310/27; 336/199, 225

[56] References Cited

U.S. PATENT DOCUMENTS 4,381,492 4/1983 Steingroever et al. ..... 335/284

FOREIGN PATENT DOCUMENTS 2153399 10/1978 Fed. Rep. of Germany ..... 335/281

*Primary Examiner*—George Harris

*Attorney, Agent, or Firm*—Morgan & Finnegan

[57] ABSTRACT

There is disclosed an electromagnetic actuator which is provided with an electromagnet and a movable core which can be attracted by the electromagnet. The electromagnet is formed by a small plate having on its front surface facing the core a plurality of grooves in which are housed respective substantially rectilinear conductor elements. The conductor elements are electrically connected together in such a way as to define on the surface a plurality of elementary magnets disposed alongside one another and having alternately opposite polarity.

12 Claims, 7 Drawing Figures

RAPID ACTING ELECTROMAGNETIC ACTUATOR

BACKGROUND OF THE INVENTION

The present invention relates to a rapid acting electromagnetic actuator, and is particularly to a rapid acting electromagnetic actuator for controlling the actuation of servo mechanisms such as solenoid valves, the print heads of teleprinters and the like.

As is known, electromagnetic actuators include an armature connected directly or indirectly, for example through suitable transmission means to the device to be controlled such as, for example, the shutter of a valve, and an electromagnet operable to draw the movable armature towards itself when it is excited. All useful electromagnets of this type substantially comprise a ferromagnetic core of suitable form, for example, a core having a cylindrical or annular or square shape and about which are spirally wound one or more conductive wires, for example, of copper. An electromagnetic actuator of this type, however, has the disadvantage of having a relatively long delay time between the initiation of the field intensity vector H and that of the magnetic induction vector B, due, above all, to the volume of iron which it is necessary to use in the magnet and to the relatively high mass of the electromagnet in relation to the volume or iron. To this delay there is also to be added the delay resulting from the necessity of accelerating the core, which is of relatively large dimensions and, therefore, of equally large mass.

To overcome this disadvantage electromagnets with conical windings have been proposed, the core of an individual magnet of this type being substantially in the form of a stepped pulley, and which type of magnet is used in association with a movable armature which is also conical. In this type of electromagnet actuator the masses involved are, however, still greater than those strictly necessary from the theoretical point of view to allow rapid actuation of the actuator itself. Moreover, such actuators are difficult to construct and can have a relatively high cost, particularly in the case in which the ferromagnetic core of such an electromagnet is to be made by sintering. Finally, there is usually the formation of parasitic currents, principally due to the slowness of actuation of the known electromagnetic actuators which must also be considered.

It is an object of the present invention to provide an electromagnetic actuator of the type described above, but which is free from the disadvantages mentioned, and in particular an actuator of a geometry which allows the masses of the movable armature and the core of the electromagnet, as well as the losses due to the initiation of parasitic currents, to be reduced to a minimum in such a way as to guarantee rapid action of the actuator itself. A further object of the present invention is to provide an electromagnetic actuator a geometry which allows a high magnetic flux linkage between the electromagnet and the movable armature in such a way as to obtain relatively high actuating forces on the armature.

SUMMARY OF THE INVENTION

The objects are achieved by the present invention by providing a rapid acting electromagnetic actuator of the type comprising an electromagnet and a movable armature which can be attracted towards the electromagnet when the electromagnet is excited and characterised by the fact that the electromagnet includes a ferromagnetic core which is a substantially flat plate provided with a flat front surface facing the armature, and a winding which comprises a plurality of substantially rectilinear conductor elements electrically connected together and disposed within respective substantially rectilinear grooves formed on the front surface of the plate.

BRIEF DESCRIPTION OF THE DRAWINGS

For a better understanding of the present invention there is given below a non-limiting description of various embodiments thereof which is to be taken in conjunction with the attached drawings in which.

DETAILED DESCRIPTION OF THE INVENTION

Figure 1:
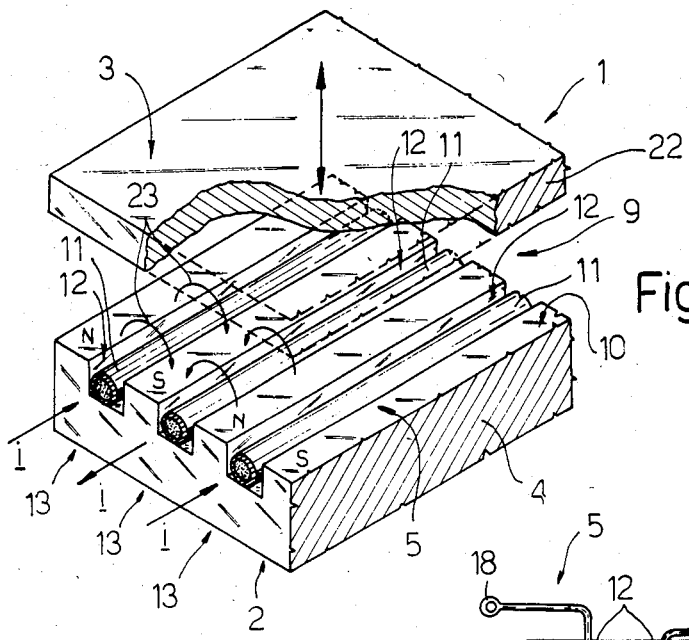
FIG. 1 illustrates a schematic perspective view of an electromagnetic actuator according to the invention.
Figure 7:
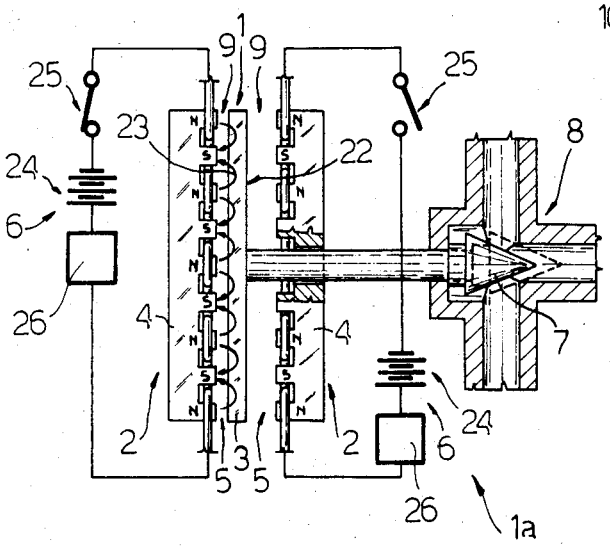
FIG. 7 schematically illustrates an exemplary application of an electromagnetic actuator constructed in accordance with the present invention.

Referring now to FIGS. 1 and 7 a rapid acting electromagnetic actuator according to the invention identified by reference numeral 1 comprises an electromagnet 2 and a movable armature 3 disposed adjacent the electromagnet 2 so that the armature can be attracted towards the electromagnet 2 when it is excited. The electromagnet 2 includes a ferromagnetic core 4 and an electrical winding 5 supplied with electrical energy (FIG. 7) by supply means 6, whilst the armature 3 can be mechanically connected, either directly or indirectly, through suitable transmission means with any appropriate movable device it is desired to actuate such as, for example, a shutter 7 of a valve 8 as schematically illustrated in FIG. 7.

According to the invention and as illustrated in FIGS. 1 and 7, the electromagnet 2 has a geometry completely different from the geometry of known electromagnets in that the core 4 thereof is a substantially flat plate provided with a flat front surface 10 facing the armature 3. The front surface 10 carries the winding 5, which in turn comprises a plurality of substantially rectilinear conductor elements 11 electrically connected together in the manner described hereinbelow. Elements 11 are disposed within respective substantially rectilinear grooves 12 formed in the core or plate 4, on the front surface 10 thereof. Grooves 12, and the conductor elements 11 within them, lie adjacent one another, and the conductors are connected in such a way that the current i which flows through them, as indicated by the arrows in FIG. 1, flows in opposite directions in two immediately adjacent conductors, as is illustrated in FIG. 1. Thus, the electromagnet 2 is formed by a plurality of elementary magnets 13 disposed adjacent one another and each of which is made up of at least one element 11 disposed within a respective groove 12 and by a portion of the plate or core 4 immediately surrounding the associated groove 12. That is to say each elementary magnet 13 has a substantially U-shape transverse section and the terminal arms constitute the poles (north and south being indicated in FIGS. 1 through 7 with the letters N and S, respectively) of each magnet 13. In substance the conductor elements 11 are connected in such a way as to define, on the surface 10 of the plate or core 4, a plurality of rectilinear magnetic poles N and S having opposite polarities and disposed alternately, separated by the grooves 12. Such a type of connection can be obtained, according to the invention, in different ways, some of which are illustrated in FIGS. 2 to 6.

Figure 2:
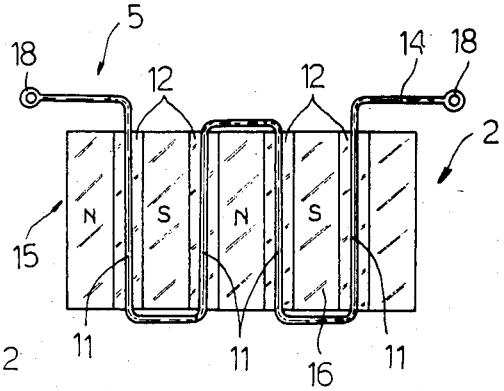
FIGS. 2 to 6 each illustrate a variant structural form of the electromagnet of the actuator of FIG. 1.
Figure 3:
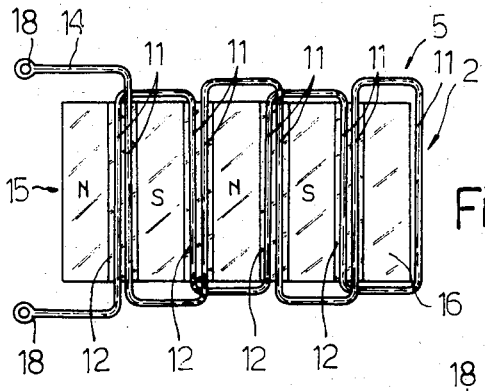
Figure 4:
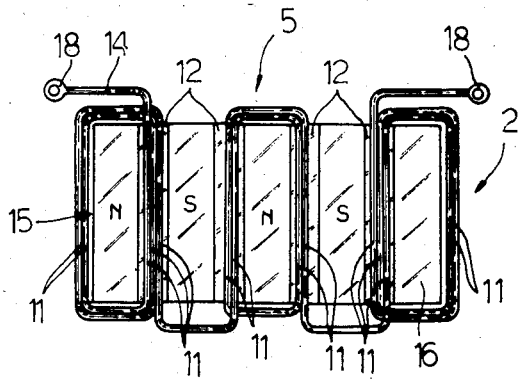
Figure 5:
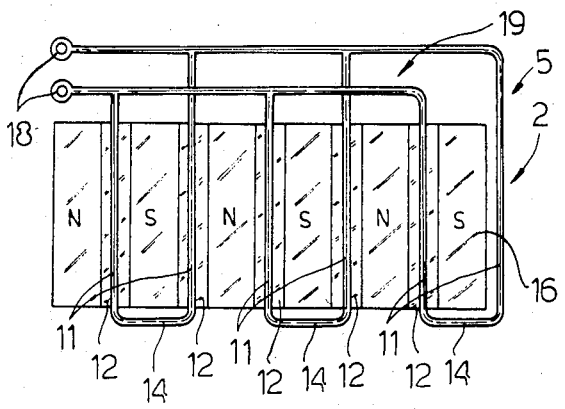

In particular, FIGS. 2 to 5 illustrate electromagnets 2 formed according to the principles of the invention in which the conductor elements 11 are sections of at least one copper wire 14 wound on the front surface 10 of the core 4 in such a way as to be completely housed within grooves 12 which are formed parallel to a rectilinear side 15 of a small rectangular plate 16 which constitutes the core 4 and which grooves are provided on one face of the surface 10 of plate 16. As illustrated in FIG. 2, the wire 14 is wound on the surface 10 in serpentine fashion, such that there is housed in each groove 12 a single rectilinear conductor section or element 11, and such that opposite supply terminals 18 for the winding 5 are disposed at opposite ends of the plate 16. As illustrated in FIG. 3, on the other hand, the wire 14 is still wound on the surface 10 in serpentine fashion, but with a double pass arrangement in which both the outward flow and the return line are on the same side 15 at which are disposed the opposite supply terminals 18 for the wire 14. Therefore, in this case, in each groove 12 there are two conductor sections or elements 11 through which the current moves in the same direction. As illustrated in FIG. 4, on the other hand, the wire 14 is wound on the surface 10 in serpentine fashion without a return winding, but each branch of the serpentine winding defined by the wire 14 is constituted by several turns thereof, there are housed a plurality (two or more) of conductor sections or elements 11 in each groove 12. Finally, as illustrated in FIG. 5, the conductor elements 11 are constituted by two sections of a series of wires 14 folded into a U-shape, disposed alongside one another and connected together in parallel to a supply line 19 provided with terminals 18.

Figure 6:
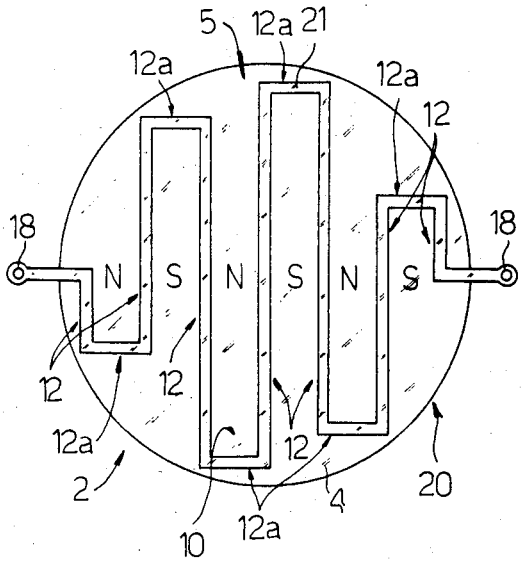

As illustrated in FIG. 6, the electromagnet 2 according to the invention can also be formed by a ferromagnetic core 4 which is a small flat disc 20 one face of which constitutes the surface 10 provided with the grooves 12 which are formed, as in the preceding example, parallel to one another and are connected together in a continuous manner by further grooves 12*a* perpendicular thereto in such a way as to define a rectilinear Greek key pattern of variable width as illustrated in FIG. 6. In this case, too, the winding 5 can be a wire 14, not illustrated, which is made to pass one or more times through the interior of the Greek key pattern recesses collectively formed on the surface 10 by the various grooves 12 and 12*a* or else can be a single copper track 21 formed by any suitable known technique on the surface 10 such that the electromagnet 2 assumes substantially the aspect of a printed circuit. In this case, as illustrated in FIG. 6, each conductor 11 is a layer of copper which is partially embedded in the ferromagnetic core within the respective grooves 12.

According to the invention, the movable armature 3, as illustrated in FIGS. 1 and 7, also a substantially flat plate, identified by 22 and which is made of ferromagnetic material. According to the invention, the armature is formed with a relatively small thickness which is substantially equal to or less than the pitch of the winding 5. The plate 22 is disposed parallel to and facing the plate constituting the ferromagnetic core 4 of the electromagnet 2 and, since both the electromagnet 2 and the armature 3 are substantially flat, the air gap 9 is also substantially flat and covered by a "magnetic skin" constituted by lines of flux 23 generated by the current i (see FIG. 1) which links the armature 3 and the core 4 when the electromagnet 2 is excited. That is to say when current is supplied to the electromagnet according to the invention, the surface 10 delimits the whole of the air gap 9 between the armature 3 and the electromagnet 2 and this latter has a relatively small axial length with respect to the transverse dimensions of the surface 10 and, therefore, is substantially flat. According to the invention the core 4 is made of a ferromagnetic material having a high saturation flux and a relatively high resistivity. For example, the core 4 can be made from a thin ferro-cobalt laminate, amorphous iron, ferrites or other similar materials. In particular, in a preferred embodiment of the invention, the core 4 is made of a sintered ferrite. Moreover, according to the invention, the transverse dimensions of each pole, N and S, of the electromagnet 2 are such as to be substantially equal to the thickness of the plate 22 constituting the armature 3.

In a particular embodiment illustrated in FIG. 7 the shutter 7, of the valve 8 is controlled by an actuator 1*a* made up of the combination of a pair of actuators 1 according to the invention mounted opposite one another with a common armature operable to control, respectively, the opening and the closing of the shutter 7. The absence of biasing springs in the actuator 1*a* according to the invention ensures a low current consumption not only during transits, when the shutter 7 changes position, but also during periods when the shutter is maintained in the associated working position (open or closed), since there are no significant biasing forces to be overcome and, obviously one of the two electromagnets 2 is deactivated when the other is activated.

According to the invention, and as illustrated in FIG. 7, moreover, each actuator 1 includes, as well as the armature 3 and the electromagnet 2, supply means 6 for supplying energy to the winding 5. Such means are schematically shown in FIG. 7 with a supply circuit of any known type provided with an energy source 24, a mechanical and/or electronic switch 25 of any known type and, in the preferred embodiment of the invention, a device 26 for controlling the current delivered by the source 24 and, therefore, supplied to the winding 5; according to the invention, device 26 is able to control the current during start-up and thereafter to supply the winding 5 with a current smaller than the initial current. Device 26 can be any known type of device which is capable of controlling the current and substantially allows the electromagnet 2 to be supplied with a relatively high current during the period immediately subsequent to the closure of the switch 25 and, then, after a relatively short time corresponding substantially to that necessary for establishment of a magnetic induction vector B proportional to the corresponding field intensity vector H, with a relatively lower current than that supplied during start-up and such as not to create overloading of the electromagnet 2.

From what has been described the advantages of the present invention will be apparent. The particular geometry adopted for the electromagnet of the actuator according to the invention in fact allows an optimal distribution of the flux lines of the magnetic field to be obtained (flat air gap and divided magnetic field) and, therefore, minimize the amount of iron necessary for the construction of the core, these factors being essential to obtain high speed actuation which also allows short delay times to be obtained between the initiation of the vector H and of the vector B, which are related to the losses in the iron, being proportional to the volume of the iron. Moreover, the particular geometry adopted for the electromagnet 2 allows a simple and economic realisation of the core 4 thereof with sintered ferrite and, therefore, permits a further increase in the performance of the electromagnetic actuator according to the invention due to the use of this material.

Further, it is to be noted that tangential forces due to the electromagnet are absent. These occur in the known devices such as those that employ a conical armature and conical electromagnet, and since such forces are equally generated they have to be balanced by suitable guides which, to guarantee the coaxiality between the conical core and the armature have to be made with significant precision and, therefore, at high cost.

Finally, providing the electromagnet according to the invention with supply means operable to vary the current supplied thereto during start-up allows an even more rapid operation of the electromagnetic actuator to be achieved, and also allows the utilisation of a smaller amount of copper for the electrical windings. In addition, it also permits simple production of multiple actuators, such as the actuator 1*a* which is capable of reversible operation through the use of two counterposed normal actuators.

From what has been described it will be clear that variations and modifications of the electromagnetic actuator of the present invention can be made without departing from the scope of the invention.

We claim:

1. A rapid acting electromagnetic actuator comprising an electromagnet and a movable armature which can be attracted towards said electromagnet when the electromagnet is excited, characterized by the fact that said electromagnet includes a ferromagnetic flat core in a shape of a substantially flat plate having a flat front surface facing said armature, and a winding comprising a plurality of substantially rectilinear conductor elements electrically connected to each other and disposed within respective substantially rectilinear grooves formed on the front surface of said plate.

2. An electromagnetic actuator according to claim 1, wherein the electromagnet includes a plurality of elementary magnets located adjacent one another and each of which is constituted by at least one set of conductor elements disposed within one groove on the front surface of the plate, and by a portion of said plate immediately surrounding said groove each elementary magnet having a substantially U-shape transverse section and the conductor elements being connected in such a way to define on said front surface of said plate a plurality of rectilinear magnetic poles (N,S) having opposite polarity and disposed alternately, N to S and being separted from each other by said grooves.

3. An electromagnetic actuator according to claim 1, wherein the front surface of the plate delimits the whole of the air gap lying between the armature and the electromagnet said electromagnet having a relatively short axial length with respect to the transverse dimensions of said front surface so as to be substantially flat.

4. An electromagnet actuator according to claim 1, wherein the ferromagnetic core is a rectangular flat plate having one surface which is provided with grooves which are disposed parallel to one side of said plate.

5. An electromagnetic actuator according to claim 1, wherein the ferromagnetic core is a flat disc having one surface which is provided with grooves which are disposed parallel to one another and are connected together by further grooves disposed perpendicular thereto thereby forming on said surface a channel in the form of a rectilinear Greek key pattern.

6. An electromagnetic actuator according to claim 1, wherein the movable armature is a second plate made of ferromagnetic material and disposed parallel to and facing the flat core plate of the electromagnet.

7. An electromagnetic actuator according to claim 6, wherein the thickness of the second plate constituting the movable armature is substantially equal to or less than the pitch of the winding that is to the transverse dimensions of each of the poles (N,S).

8. An electromagnetic actuator according to claim 1, wherein the conductor elements are sections of at least one copper wire wound on the front surface of the ferromagnetic core in such a way as to be completely housed within the interior of the grooves.

9. An electromagnetic actuator according to claim 1, wherein the conductor elements are formed by a strip of copper which is partially embedded in the ferromagnetic core and is disposed within the grooves.

10. An electromagnetic actuator according to claim 1, wherein the ferromagnetic core is made of sintered ferrite.

11. An electromagnetic actuator according to claim 1, including supply means for supplying energy to the winding of the electromagnetic and for varying the current supplied to the said electromagnet during start-up thereof and subsequently supplying said electromagnet with a current less than the initial current.

12. An electromagnetic actuator according to claim 1, including two electromagnetic actuators arranged in opposed positions and having a common movable armature disposed between them.

* * * * *